US010030419B2

(12) United States Patent
Lin

(10) Patent No.: US 10,030,419 B2
(45) Date of Patent: Jul. 24, 2018

(54) FIRE DOOR LOCK

(71) Applicant: Thase Enterprise Co., Ltd., New Taipei (TW)

(72) Inventor: Ching-Tien Lin, New Taipei (TW)

(73) Assignee: Thase Enterprise Co., Ltd., New Taipei (TW)

( * ) Notice: Subject to any disclaimer, the term of this patent is extended or adjusted under 35 U.S.C. 154(b) by 418 days.

(21) Appl. No.: 14/802,121

(22) Filed: Jul. 17, 2015

(65) Prior Publication Data

US 2016/0017641 A1 Jan. 21, 2016

(30) Foreign Application Priority Data

Jul. 17, 2014 (TW) ..... 103212693

(51) Int. Cl.
*E05B 65/10* (2006.01)
*E05B 63/16* (2006.01)

(52) U.S. Cl.
CPC ..... *E05B 65/104* (2013.01); *E05B 65/1053* (2013.01); *E05B 63/16* (2013.01)

(58) Field of Classification Search
CPC ..... E05B 65/1053; E05B 65/1006; E05B 2047/0016; E05B 47/0004; E05B 65/1046; E05B 65/10; Y10T 292/0908; Y10T 70/5159; Y10T 292/0822; Y10T 292/23; Y10S 292/65
See application file for complete search history.

(56) References Cited

U.S. PATENT DOCUMENTS 1,756,667 A * 4/1930 Soemer ..... E05B 65/1066 292/165
5,823,582 A * 10/1998 Frolov ..... E05B 65/1053 292/21
5,947,534 A * 9/1999 Zarzycki, Jr. ..... E05B 65/1053 292/170
2011/0248518 A1* 10/2011 Tien ..... E05B 13/005 292/336.3

* cited by examiner

*Primary Examiner* — Mark A Williams
(74) *Attorney, Agent, or Firm* — Amin, Turocy & Watson LLP

(57) ABSTRACT

A fire door lock is provides. A first opening unit is installed in a fire door panel to move a door locking bolt. A second opening unit laterally located on the fire door has a pressing handle coupled with an actuating block for operating the locking bolt. When the pressing handle is pushed and pressed, the actuating block activates an actuating rod and a linking arm to move horizontally. One end of the linking arm is coupled to a driving lever which is induced by the linking arm to swing. One end of the driving lever has a pulley extending into the first opening unit to activate a locking bolt base connected to the locking bolt to move horizontally. The locking bolt is accordingly adapted to extend from or retract into the first opening unit in a horizontal direction to facilitate the release or engagement of the lock.

15 Claims, 9 Drawing Sheets

FIRE DOOR LOCK

BACKGROUND OF THE PRESENT INVENTION

1. Field of the present invention

The present invention relates to fire door locks, and, more particularly, to a fire door lock which allows a user to easily push forward to open a fire door mounted with the fire door lock.

2. Description of Related Art

A conventional fire door, as shown in FIG. 1, is opened by pressing a handle 11 of a handle frame base 10 horizontally located in the middle of the fire door, whereby a locking bolt 12*d* in a lock housing 12 is retracted and relieves a locked state that closes and locks the fire door and the fire door is opened. This operation is achieved by a diagonal depression motion of the handle 11 which is pressed by a user to move in a downward and diagonal direction.

Please refer to FIGS. 2 and 3, which show a conventional fire door lock that is rotated by 90 degrees and oriented in a horizontal direction for clear illustration. The handle frame base 10 houses a pressing handle 11 that allows a user to press downwards and a lock housing 12 that accommodates a locking bolt 12*d*. The pressing handle 11 is screwed to two fixing seats 13 located at the bottom of the handle frame base 10. A roller sliding pillar 13*b* penetrates through two slanted slots 13*a* respectively formed on two side walls of each of the fixing seats 13, and is fixed to the side walls of the fixing seats 13 by means of a shim 13*c*. A pin 13*e* having a wound elastic member 13*d* thereon is secured to the bottom of each of the fixing seats 13. One end of the elastic member 13*d* is in contact with the bottom of the roller sliding pillar 13*b* on which an upward compression force is exerted.

Under a normal condition, the shim 13*c* of the roller sliding pillar 13*b* holds the handle 11 in position at the top of the handle frame base 10. When the user exerts a force on the handle 11, the roller sliding pillar 13*b* is pushed downwards and travels along the slots 13*a* of each fixing seat 13 by the force, thereby inducing diagonal translocation of the handle 11 in the handle frame base 10.

The lock housing 12 located at the front of the handle frame base 10, shown in FIG. 3, comprises a seesaw lever 12*a* which is constructed by coupling a push part 12*b* and a pull part 12*c*, wherein the push part 12*b* is in contact with an inside surface of the handle 11 and the pull part 12*c* is engaged with a cavity 12*e* formed by the locking bolt 12*d* in the lock housing 12. When the user presses the handle 11, the push part 12*b* of the lever 12*a* is pushed downwards while the pull part 12*c* is moved upwards. At the same time, the pull part 12*c* comes into contact with the locking bolt 12*d* which is driven to rotate in a counterclockwise direction, making the locking bolt 12*d* retracted into the lock housing 12 to facilitate a door opening action.

In view of the above door opening operation in the use of the conventional fire door lock, although the user presses the handle 11 in a manner as illustrated in FIG. 3, the handle 11 is moved in a diagonal direction by the roller 13*b* traveling along the slots 13*a* of each fixing seat 13 in the handle frame base 10. The diagonal movement of the handle 11 is composed of a vertical movement and a horizontal movement. The force exerted by the user is undesirably divided into two components: a force vertical to the push part 12*b* and used for operating the locking bolt 12*d*, and a force horizontal to the push part 12*b* and having no contribution to the locking bolt 12*d*, which therefore requires a larger amount of force exerted by the user due to wastage. Further, the horizontal movement of the handle 11 makes the travel direction of the handle 11 different from that of the hands of the user, which causes discomfort to the hands of the user when operating the door lock.

Furthermore, when the conventional fire door lock is used in a fire accident, because there is no fire protection elements mounted in the fire lock, and the door lock does not have to prevent from opening, it is likely that a person, who does not realizes the fire condition, may mistakenly open the fire door lock, resulting in injuries and death caused by the fire, and the fire may start to spread. Therefore, a novel, improved fire door lock which can eliminate the above drawbacks is greatly desired.

SUMMARY OF THE PRESENT INVENTION

An objective of the present invention is to provide a fire door lock which allows a user to press a handle in a vertical direction with respect to a first door mounted with the fire door lock to activate a locking bolt in a comfortable manner to open the first door.

Another objective of the present invention is to provide a fire door lock which allows the locking bolt to extend from a lock housing to be directly inserted into a hole of the locking bolt formed on an inner side of a door frame, such that when the door lock is engaged, the locking bolt cannot be easily damaged by vandals, thereby increasing the security of the door lock.

In order to achieve the above and other objectives, the present invention provides a fire door lock, specifically featuring the improvement on the pressing handle of the fire door lock, which allows a first opening unit thereof to be located inside a fire door mounted with the lock and to activate a locking bolt of the lock to move. Moreover, a second opening unit laterally located on the fire door has a pressing handle coupled with an actuating block for operating the locking bolt. When the pressing handle is pushed and pressed, the actuating block activates an actuating rod and a linking arm to move horizontally. One end of the linking arm is coupled to a driving lever, and driving lever drives the linking arm to swing. One end of the driving lever has a pulley extending into the first opening unit to activate a locking bolt base connected to the locking bolt to move horizontally. As a result, the locking bolt is accordingly adapted to extend from or retract into the first opening unit in a horizontal direction to facilitate the release or engagement of the lock.

Furthermore, the first opening unit of the fire door lock comprises a rotation device having a rotatable block coupled to a rotatable handle with a bolt lever, so as to allow the rotatable block to be driven by the rotatable handle to activate a rotatable plate having a protruding block that is coupled to the locking bolt base. When the rotatable plate rotates, the blocking arm exerts a force on the locking bolt base and induces the locking bolt base to move horizontally, such that the locking bolt connected to the locking bolt base can extend from and retract from the lock housing to engage or disengage the lock, thereby making the user to operate the handle and open the fire door in a comfortable manner.

Further, one side of the handle of the present invention is a strengthened structure.

In addition, the present invention is an improved invention of the Taiwan Patent No. 547533.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

Figure 1:
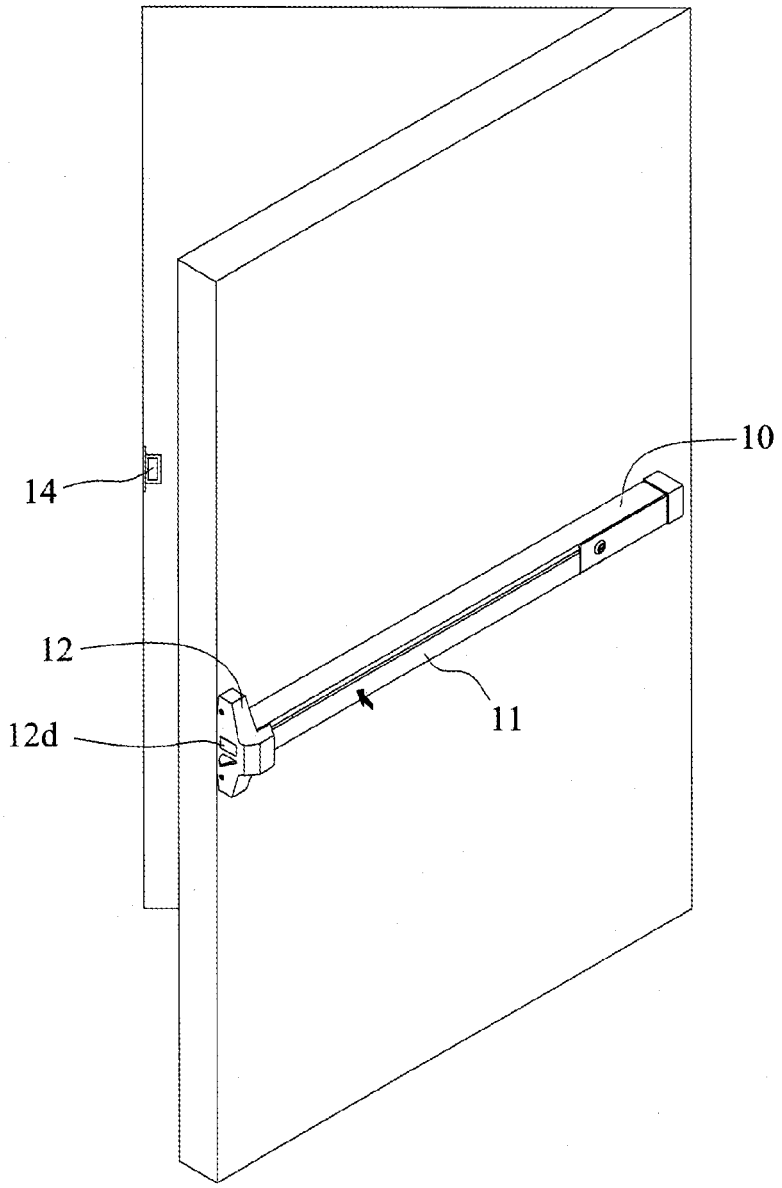
FIG. 1 (PRIOR ART)
FIG. 1 (PRIOR ART) is a schematic diagram of a fire door mounted with a conventional fire door lock.
Figure 2:
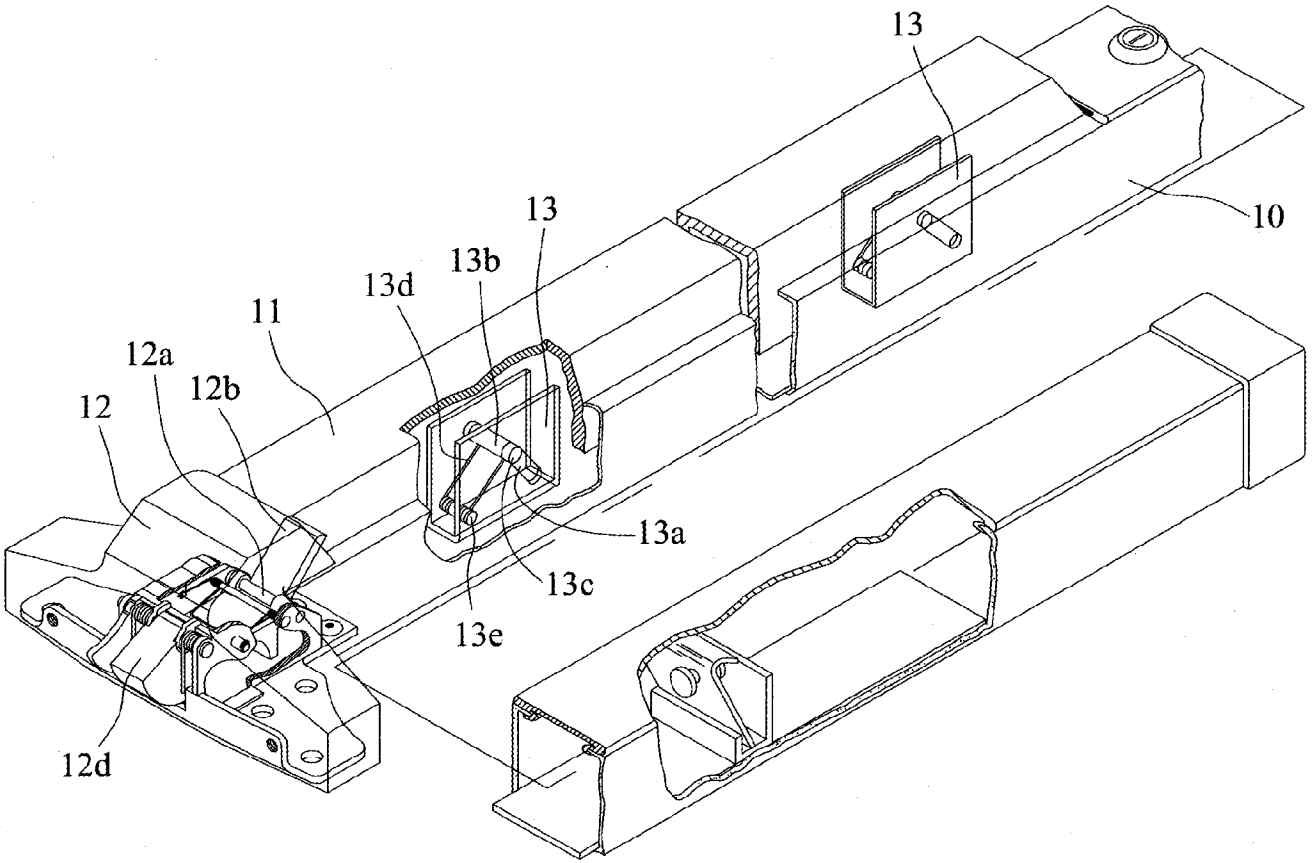
FIG. 2 (PRIOR ART)
FIG. 2 (PRIOR ART) is a schematic diagram showing the structure of the conventional fire door lock.
Figure 3:
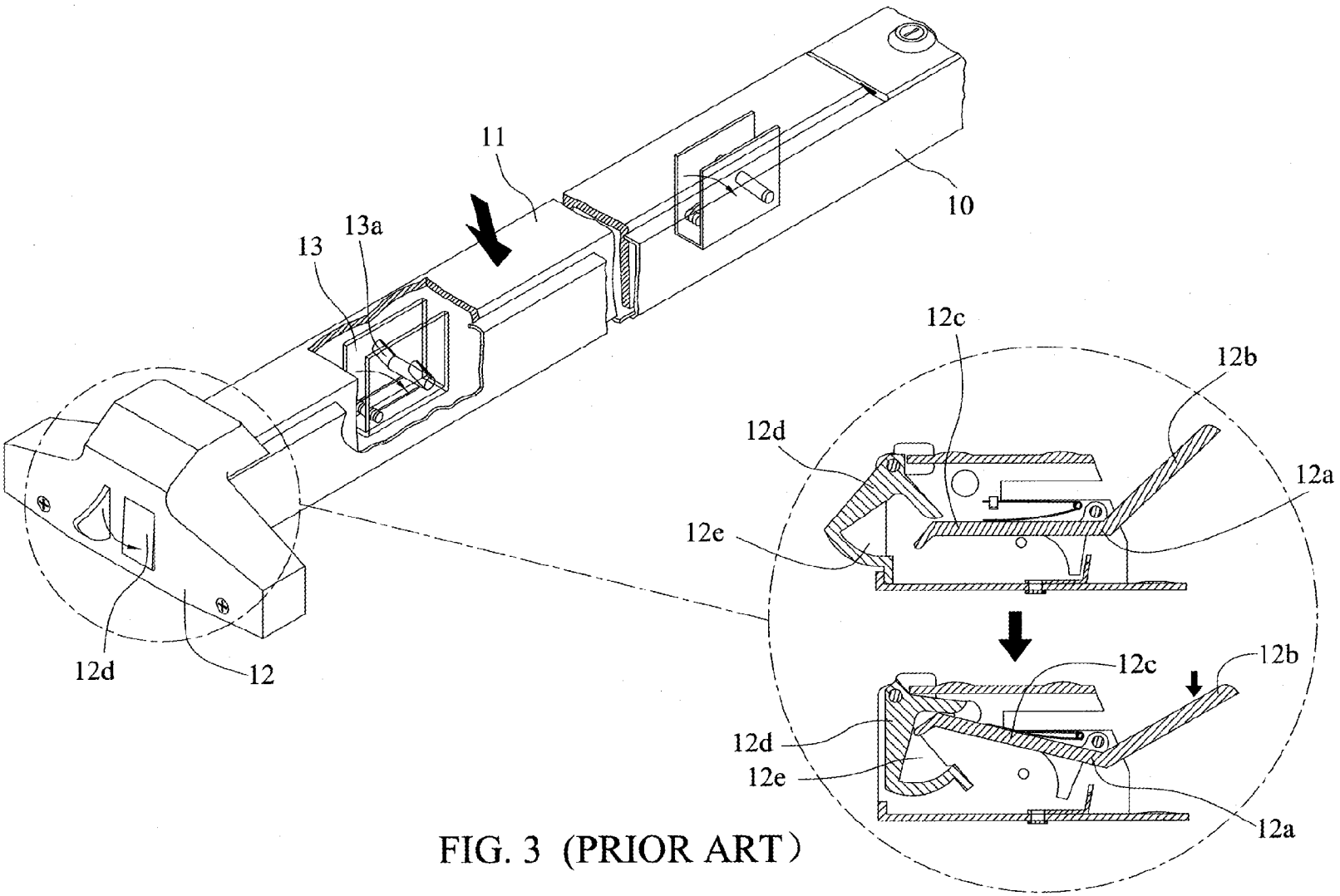
FIG. 3 (PRIOR ART)
FIG. 3 (PRIOR ART) is a schematic diagram showing the mechanics of the conventional fire door lock.
Figure 4:
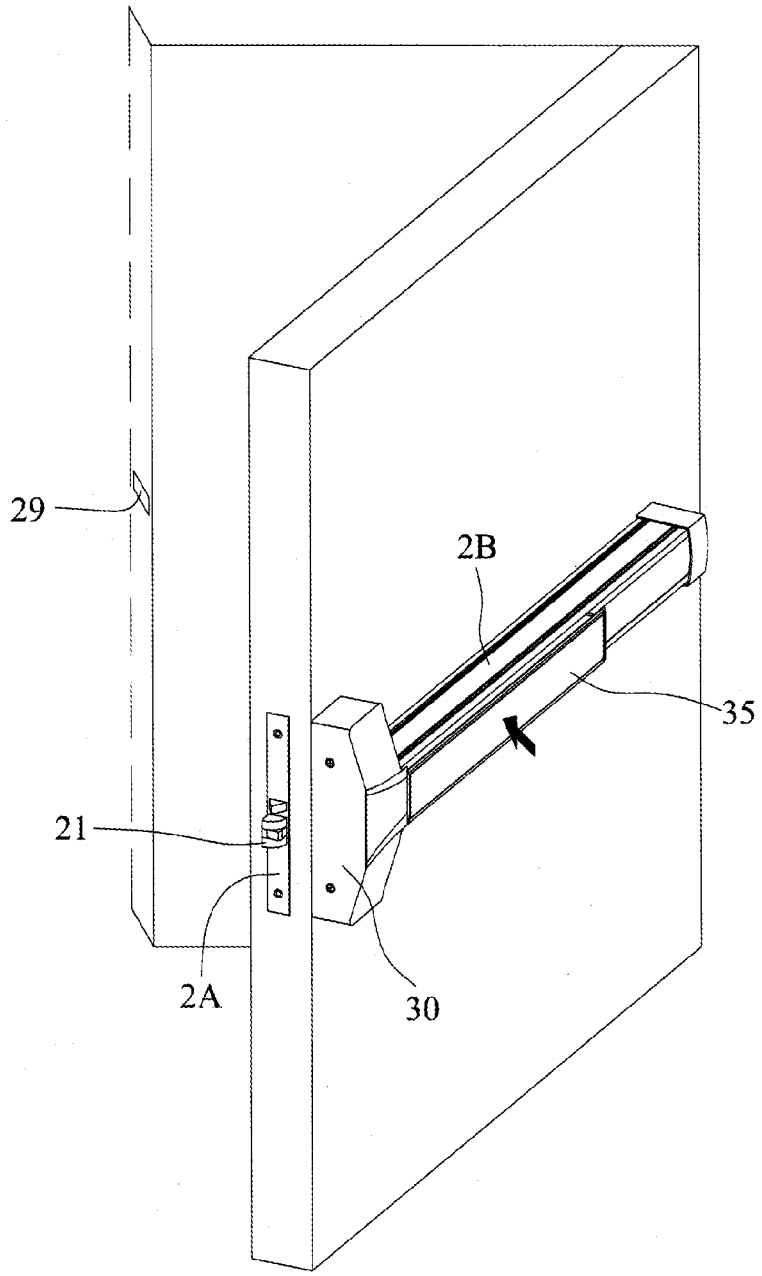
FIG. 4 is a schematic diagram of the appearance of a fire door mounted according to the present invention.

FIG. 4 is a schematic diagram of a fire door mounted with a fire door lock according to a preferred embodiment of the present invention. The lock comprises a first opening unit 2A and a second opening unit 2B, and in particular features an improvement on the transmission components of the pressing handle 35 of the second opening unit 2B mounted on a fire door. The first opening unit 2A is disposed between door panels inside the fire door for activating a locking bolt 21 to extend from and retract into the first opening unit 2A in a horizontal direction so as to engage or disengage the lock.

Figure 5:
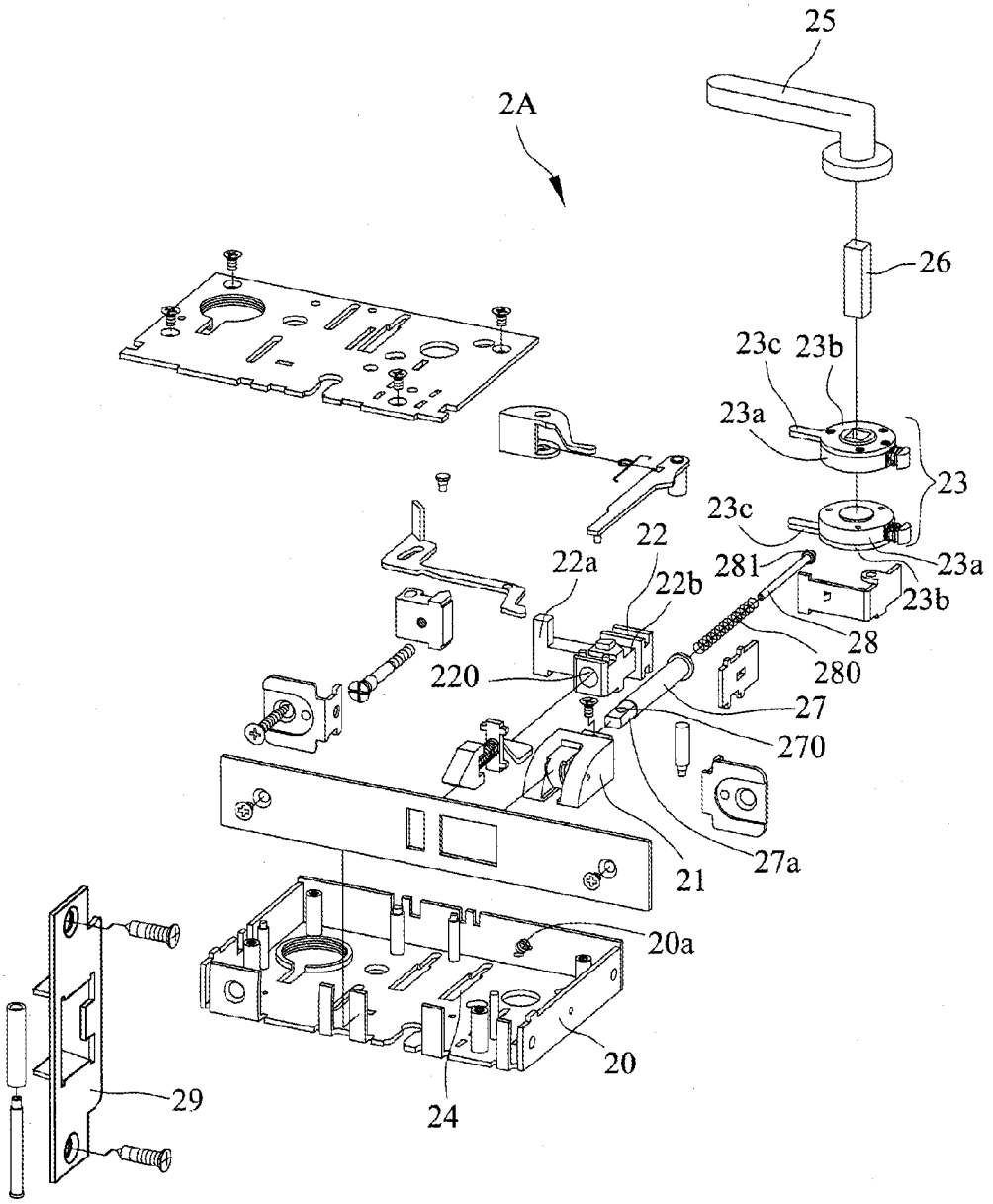
FIG. 5 is an exploded diagram of a first opening unit of the fire door lock according to the present invention.
Figure 6:
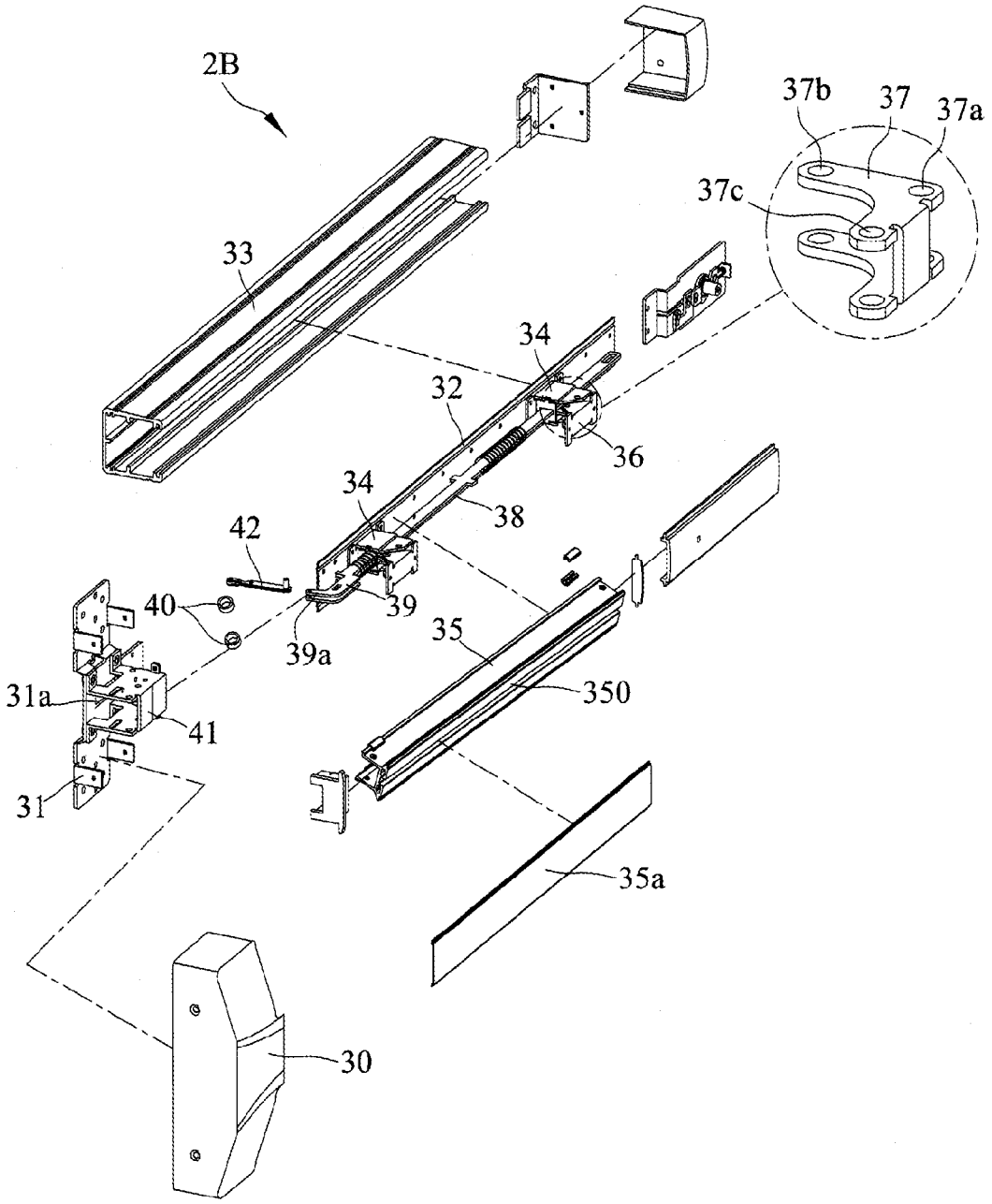
FIG. 6 is an exploded diagram of a second opening unit of the fire door lock according to the present invention.

Please refer to FIGS. 5 and 6, which illustrate the first opening unit 2A and the second opening unit 2B, respectively.

As shown in FIG. 5, the first opening unit 2A comprises: a lock housing 20 for accommodating the transmission components of the locking bolt 21; a locking bolt base 22 having a protruding part 22*a*; and a rotation device 23 connected to an external rotatable handle 25 to induce a movement.

A slot hole 24 is formed on the bottom of the lock housing 20 corresponding to the protruding part 22*a* of the locking bolt base 22, allowing one end of the locking bolt base 22 to be coupled to the locking bolt 21, such that the locking bolt 21 can freely extend from and retract into the lock housing 20 along with the horizontal movement of the locking bolt base 22.

The rotation device 23 has an upper rotatable block 23*a* and a lower rotatable block 23*a*, each of which is coupled to a rotatable plate 23*b*, so as to allow a blocking arm 23*c* formed as an extension from the rotatable plate 23*b* to be secured in the recessed portion 22*b* of the locking bolt base. When a movement is made by rotating the rotation handle 25, the blocking arm 23*c* rotates to induce a horizontal movement of locking bolt base 22.

In an embodiment, a rotation device 23 coupled to the rotation handle 25 is accommodated in the lock housing 20. The rotation handle 25 is installed on the outer door panel of the fire door, and the rotation handle 25 drives the rotation device 23 via the bolt lever 26.

In addition, as shown in FIG. 5, the lock housing 20 receives the rotation device 23 coupled to the rotatable handle 25 operatable by the user. The rotatable handle 25 is disposed on a side of the fire door that faces the outside and coupled to the rotation device 23 by a bolt lever 26.

Figure 7:
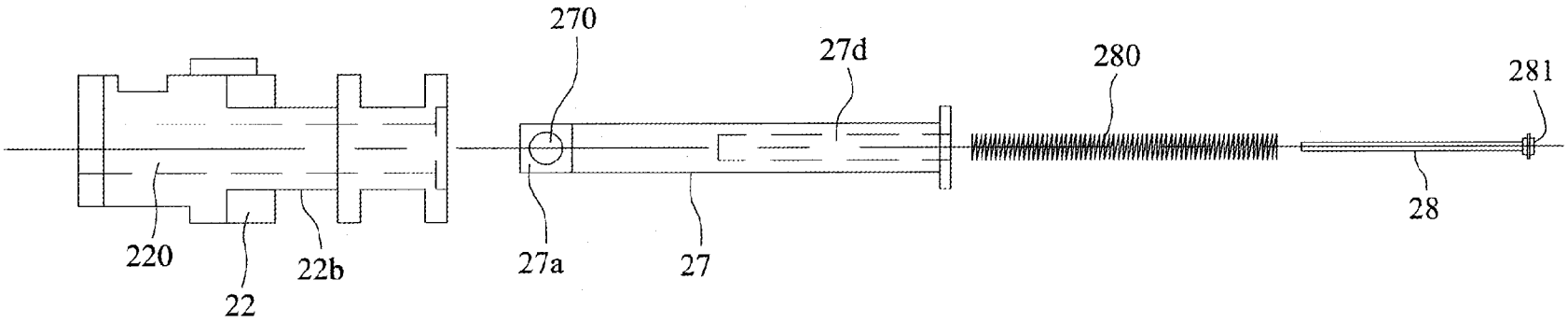
FIG. 7 is a schematic diagram showing part of components of the fire door lock according to the present invention.

A hole 220 is formed at a central position in the locking bolt base 22 and accommodates an axial tube 27 having a flat front close end 27*a* on one side. A through hole 270 is formed at the flat front end 27*a* of the axial tube 27 for receiving a screw connected to the locking bolt 21. As shown in FIG. 7, a hole 27*d* is formed at the other open end of the axial tube 27 and which allows an axial rod 28 sleeved with an elastic member 280 thereon to be inserted into the hole 27*d*.

The axial rod 28 has one end formed with a blocking part 281 that has a larger diameter than the elastic member 280 for securing the elastic member 280 in position. The elastic member 280 has a length greater than that of the axial rod 28 and the depth of the hole 27*d* of the axial tube 27, such that by provision of the blocking part 281 of the axial rod 28, the elastic member 280 is held in a compressed status inside the hole 27*d* of the axial tube 27.

Furthermore, the blocking part 281 of the axial rod 28 is inserted into a hole 20*a* on a side wall of the lock housing 20, such that one end of the axial rod 28 is secured to the side wall of the lock housing 20, and the other end of the axial rod 28 is mounted on the elastic member 280 on the axial tube 28, to press the axial tube 27 to move towards a locking bolt catch 29, thereby inducing the locking bolt 21 to protrude from the lock housing 20.

When the recess portion 22*b* of the locking bolt base 22 is moved by the blocking arms 23*c* of the rotatable plates 23*b* of the rotatable handle 25, due to a force exerted from the blocking arms 23*c* being greater than a force pressed on the axial tube 27 by the elastic member 280, the locking bolt base 22 is pushed by the blocking arms 23*c* towards a direction away from the locking bolt catch 29, making the locking bolt 21 retract into the lock housing 20 to release or disengage the lock.

Referring to FIG. 6, the second opening unit 2B comprises: a lock cover 30, a lock cover base plate 31, a bottom frame plate 32, a recessed bottom frame 33, a first carrier seat 34, a pressing handle 35, a second carrier seat 36, an actuating block 37, an actuating rod 38, a linking arm 39, a sliding base 40, a lock cover base plate 41, and a driving lever 42.

The lock cover 30 accommodates the locking bolt transmission components, wherein the bottom of the lock cover 30 is coupled to a lock cover base plate 31 and one end thereof is coupled to a bottom frame plate 32 engaged with a recessed bottom frame 33.

The first carrier seat 34 is provided at each of two ends of the bottom frame plate 32 and is triangular.

The pressing handle 35 is accommodated in the bottom frame 33 and provides the user to press to release the lock by a downward and upward movement. The two bottom ends of the pressing handle 35 are each secured on the second carrier seat 36. The pressing handle 35 has a cover 35*a* allowing the user to press down and disengage the lock.

In an embodiment, one side of the pressing handle 35 has a strengthened structure 350 (such as a recessed portion), which is integrally formed, without the need of forming lock holes, thereby preventing damages caused by stress due to the installation of holes.

The second carrier seat 36 is located at each of two bottom ends of the pressing handle 35 and is triangular.

The actuating block 37 is bent by a right angle to form a central portion 37*a*, a left end portion 37*b*, and a right end portion 37*c*. The central portion 37*a* is coupled to the first carrier seat 34, and the right end portion 37*c* is coupled to the second carrier seat 36, to generate a swinging motion of the actuating block with the second carrier seat as a pivot.

Furthermore, the actuating block 37 is formed with a recess portion by which the actuating block 37 can be bridged on the actuating rod 38. When the second carrier seat 36 receives a force from the pressing handle 35 pressed by the user and moves, the left end portion 37*b* of the actuating block 37 is accordingly adapted to move at the same time, making the right end portion 37*c* of the actuating block 37 to swing about the shim 34*b* as a pivot in the pivot hole 34*a* of the first carrier seat 34, to thereby induce a horizontal movement of the actuating rod 38 and the linking arm 39 coupled to the actuating rod 38.

The linking arm 39 is coupled to one end of the actuating rod 38, and receives the pulling forces in the horizontal direction according to the movement of the actuating rod 38 and the front end of the linking arm 39 is formed with a bending part 39*a* to couple with the driving lever 42.

The driving lever 42 is coupled to one end of the linking arm 39 to generate a swing movement induced by the movement of the linking arm, so as to induce a horizontal movement of the locking bolt base 22 through the slot 24 of the first opening unit 2A.

The lock cover base plate 41 accommodates the linking arm 39 and the driving lever 42, and the driving lever 42 is mounted on the lock cover base plate 41 to induce a swing movement.

The swing sliding base 41 is a rotation objection (such as a wheel) to be pivotally mounted on one end of the driving lever 42, and moves horizontally induced by the horizontal force by the linking arm 39 coupled with the actuating rod 38.

In the present embodiment, the sliding base 41 can extend from a slot hole 31*a* at a central position of the lock cover base plate 31 or retract into the slot 24 at the bottom of the lock housing 20. The sliding base 40 is in contact with the protruding part 22*a* of the locking bolt base 22. Through the swing movement of the driving lever 42 to induce a horizontal movement, the sliding base 40 pushes the locking bolt base 22, such that the locking bolt base 22 can extend out of the lock housing 20 to make the fire door lock in a locked position.

Figure 8A:
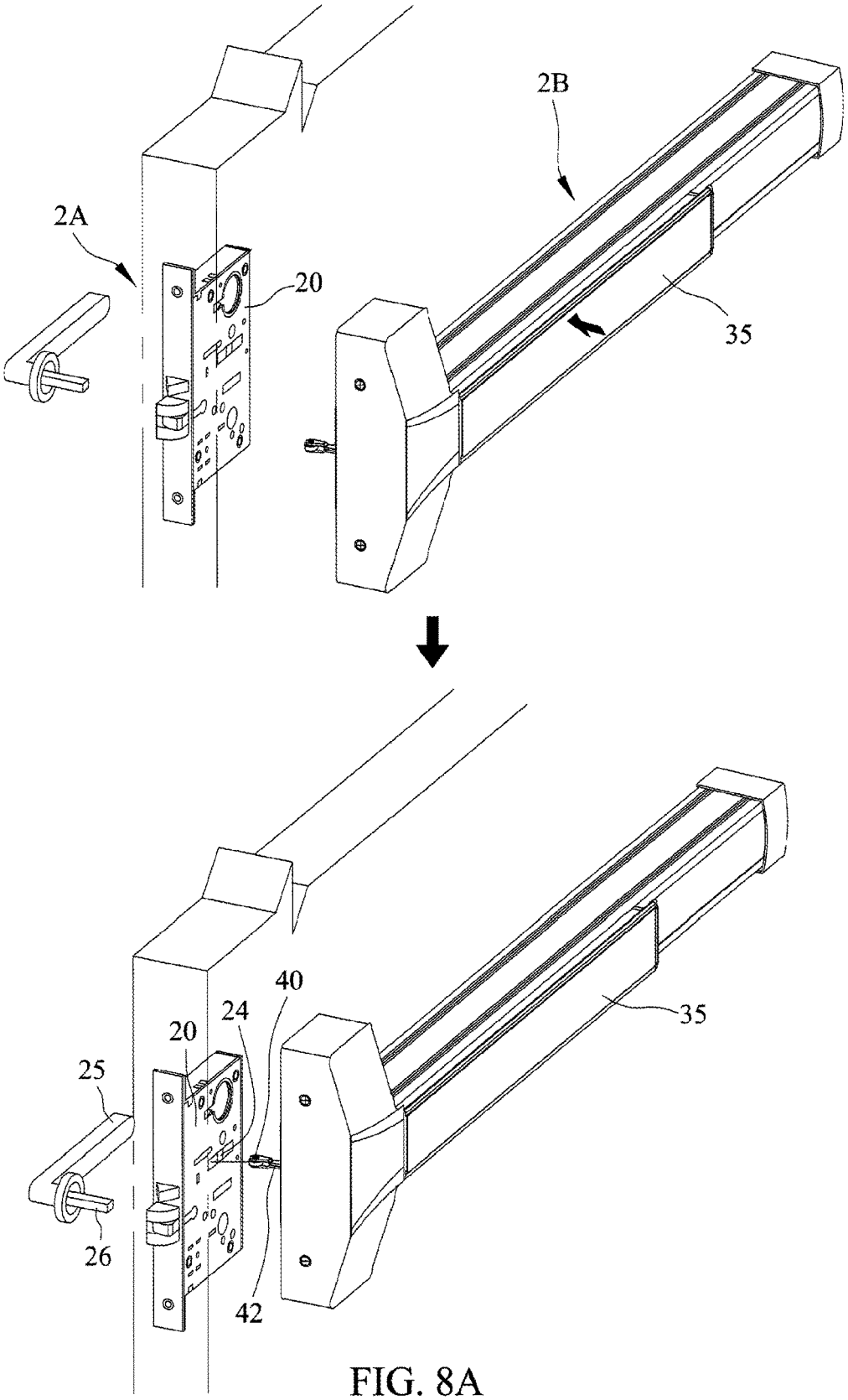
FIGS. 8A and 8B are perspective diagrams showing the structure of the fire door lock according to the present invention.
Figure 8B:
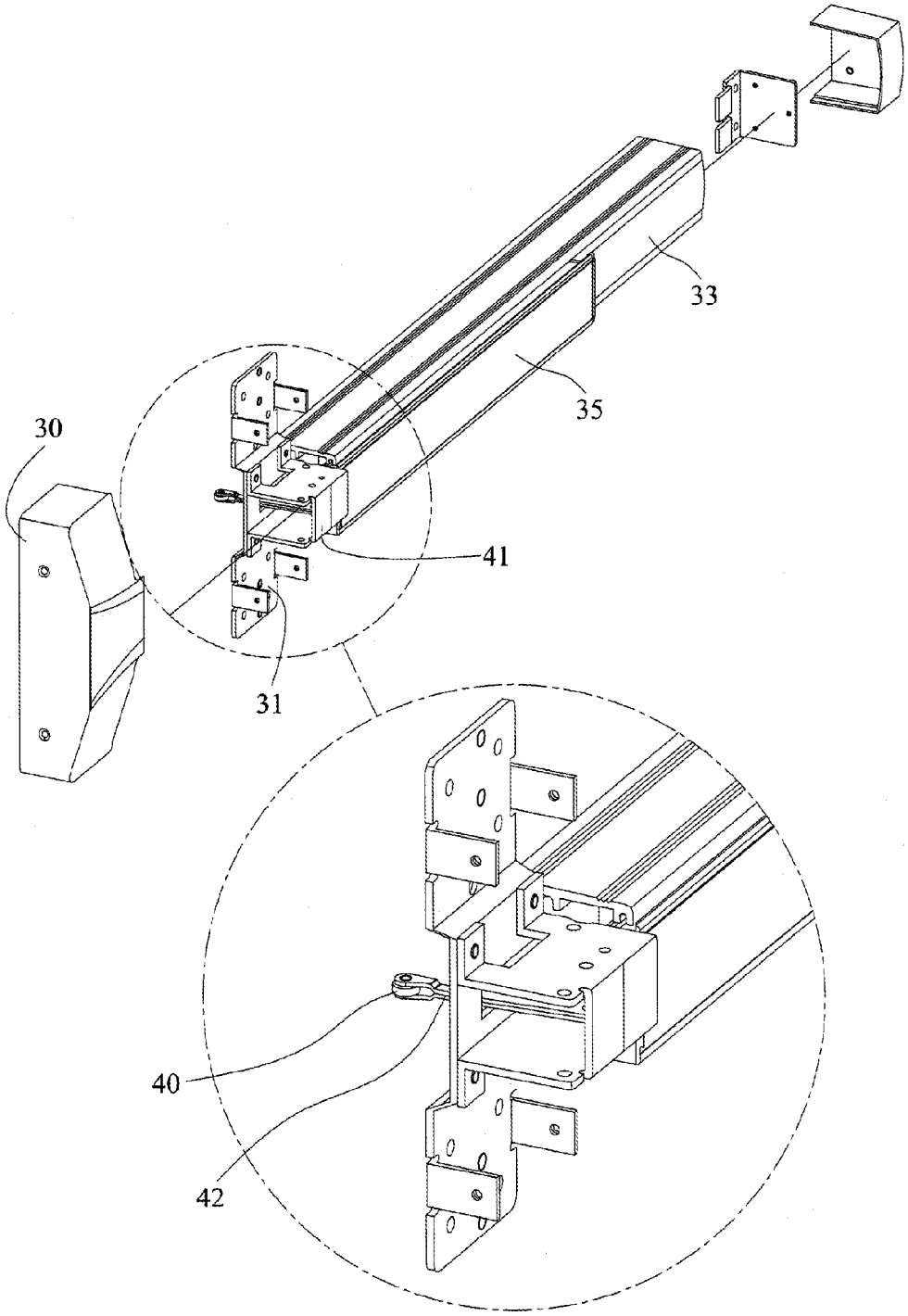

The function of the present prevention is achieved through the following manners, as shown in FIGS. 8A and 8B. When the driving lever 42 is pressed down through the pressing handle 35 by a user, the actuating rod 38 is pushed to generate a movement, such that the sliding base 40 pushes the engaged locking bolt base 22 to induce a horizontal movement, allowing the locking bolt 21 on one end of the locking bolt base 22 to move away from the locking bolt catch 29 and retract into the lock housing 20 to disengage the lock.

The locking bolt base 22 can be made of a heat melting material. When the fire door lock experiences a high temperature in a fire, the locking bolt base 22 melts and the axial tube 27 fails to be moved by the blocking arms 23*c* of the rotation device 23. In the meantime, pressing the rotatable handle 25 or the pressing handle 35 cannot push the axial tube 27 to move towards a door frame of the fire door; on the other hand, the elastic member 280 inside the axial tube 27 and on the actuating axial rod 28 can generate a compression force to move the axial tube 27 towards the locking bolt catch 29, thereby making the locking bolt 21 connected to one end of the axial tube 27 move towards the locking bolt catch 29 and extend from the lock housing 20. to maintain the door in a locked state during the fire. As a result, the lock cannot be released or disengaged by operating the external rotatable handle 25 or the pressing handle 35, such that the fire door cannot accidentally opened during the fire and the flames can be prevented from spreading to unintended areas to damage people for the sake of the safety purpose, ensuring the fire door comply with the building fire safety legislation. In addition, the transmission components described in the present invention provide a better functionality, and are capable of preventing the possibility of failures with high safety requirement.

In summary, the combinations of the foregoing fire door components provide a power-saving, and comfortable manner to disengage the locked state of the fire door.

The present invention has been described using exemplary preferred embodiments. However, it is to be understood that the scope of the present invention is not limited to the disclosed embodiments. On the contrary, it is intended to cover various modifications and similar arrangements; for example, the connection means between the driving lever 42 and the locking bolt base 22 can be replaced by a hook or a shim, or the elastic member 280 can be modified to externally wrap the axial tube 27 or directly mounted inside the axial tube 27. The scope of the claims, therefore, should be accorded the broadest interpretation so as to encompass all such modifications and similar arrangements.

What is claimed is:

1. A fire door lock, comprising:

a first opening unit embedded in a fire door and driven by an actuating member installed on the fire door to be pushed a locking bolt of a locking bolt base received in the first opening unit for the fire door lock to enter a released or an engaged state;

a second opening unit mounted on a surface of the fire door and having a pressing handle that is disposed on the second opening unit, wherein the pressing handle includes a side that has a strengthened structure;

an actuating block rotatably disposed in the pressing handle and being bent by an angle to form a central portion and two end portions;

an actuating rod coupled onto the actuating block;

a driving lever coupled to one end of the actuating rod, extending into the fire door, and moved by a pushing of the actuating rod that is driven by the pressing handle, to push the locking bolt to enable the fire door to enter the released or engaged state; and a linking arm pivotally coupled to an end of the actuating rod and driven by the actuating rod to generate a horizontal pulling force, and having an end pivotally coupled to the driving lever and driving the driving lever to swing.

2. The fire door lock of claim 1, wherein the actuating member is a rotation handle, the rotation handle drives a rotation device that is embedded in the fire door, the rotation device has an upper rotatable block and a lower rotatable block that drive an upper rotatable plate and a lower rotatable plate to rotate, respectively, and a blocking arm disposed on the rotatable plates drives the locking bolt base to move horizontally.

3. The fire door lock of claim 1, wherein the second opening unit further comprises a lock cover that has a bottom end secured to a lock cover base plate and an end coupled to a bottom frame plate secured to a recessed bottom frame.

4. The fire door lock of claim 3, wherein the bottom frame has two first carrier seats disposed on two ends thereof, respectively.

5. The fire door lock of claim 1, wherein the actuating block is perpendicularly bent.

6. The fire door lock of claim 1, wherein the pressing handle has a second carrier seat pivotally coupled to the actuating rod.

7. The fire door lock of claim 1, wherein the linking arm and the driving lever are received in the lock cover base plate, and the driving lever is pivotally coupled to the lock cover base plate to swing.

8. The fire door lock of claim 7, further comprising a sliding base pivotally coupled to an end of the driving lever.

9. The fire door lock of claim 8, wherein the sliding base is a rotatable body.

10. The fire door lock of claim 1, further comprising a bent portion in a right-angle shape formed at a front end of the linking arm and pivotally coupled to the driving lever.

11. The fire door lock of claim 1, wherein the first opening unit has a lock housing installed in a sandwich layer of the fire door and having a slot hole formed at a corresponding position along a horizontal direction in which the locking bolt base moves, and the sliding base slides into the slot hole and contacts with the locking bolt base, to push the locking bolt base to move horizontally when the sliding base rotates.

12. The fire door lock of claim 11, further comprising a lock cover base plate coupled to the lock cover base and having a slot hole, through which the sliding base slides into the slot hole of the lock housing, wherein the driving lever is received in the lock cover base plate.

13. The fire door lock of claim 1, further comprising an axial tube mounted in the locking bolt base, and a axial rod inserted in the axial tube and having an elastic member.

14. The fire door lock of claim 13, further comprising a blocking part disposed at an end of the axial tube to position the elastic member.

15. The fire door lock of claim 1, wherein the locking bolt base is made of a heat melting material.

* * * * *